US008747051B2

(12) United States Patent
Nordström et al.

(10) Patent No.: US 8,747,051 B2
(45) Date of Patent: Jun. 10, 2014

(54) METHOD AND ARRANGEMENT FOR OCEAN FREIGHT TRANSPORTATION

(76) Inventors: Raimo Nordström, Espoo (FI); Hannu Nurminen, Mynamaki (FI)

( * ) Notice: Subject to any disclaimer, the term of this patent is extended or adjusted under 35 U.S.C. 154(b) by 135 days.

(21) Appl. No.: 13/354,525

(22) Filed: Jan. 20, 2012

(65) Prior Publication Data

US 2012/0189405 A1 Jul. 26, 2012

(30) Foreign Application Priority Data

Jan. 24, 2011 (FI) ..... 20115061

(51) Int. Cl.
*B65D 19/38* (2006.01)

(52) U.S. Cl.
USPC ..... 414/803; 414/139.8; 414/142.6; 108/64

(58) Field of Classification Search
USPC ..... 108/64; 212/307; 220/1.5; 410/32, 35, 410/45, 46, 68, 77, 78; 414/139.4, 139.8, 414/139.9, 140.3, 141.3, 141.5, 142.6, 414/142.8, 143.2
See application file for complete search history.

(56) References Cited

U.S. PATENT DOCUMENTS

| | | | | |
|---|---|---|---|---|
| 3,386,600 | A | 6/1968 | Betjemann | |
| 3,578,374 | A * | 5/1971 | Glassmeyer | 294/68.1 |
| 3,711,902 | A * | 1/1973 | Eggert, Jr. | 24/287 |
| 4,095,769 | A * | 6/1978 | Fengels | 248/346.02 |
| 4,221,515 | A * | 9/1980 | Brown et al. | 410/32 |
| 4,819,820 | A * | 4/1989 | Weiner | 220/1.5 |
| 4,966,085 | A * | 10/1990 | Howe | 108/55.1 |
| 5,040,935 | A * | 8/1991 | Gearin et al. | 414/400 |
| 5,183,305 | A | 2/1993 | Nordström et al. | |
| 5,599,153 | A * | 2/1997 | Svensson | 414/143.2 |
| 6,363,586 | B1 * | 4/2002 | Neufingerl | 24/287 |
| 6,513,442 | B1 * | 2/2003 | Miller et al. | 108/53.1 |
| 7,507,061 | B2 * | 3/2009 | Wells et al. | 410/46 |
| 2005/0019127 | A1 | 1/2005 | Sain | |
| 2006/0243724 | A1 * | 11/2006 | Shan | 220/1.5 |
| 2009/0280000 | A1 * | 11/2009 | Smith | 414/800 |

FOREIGN PATENT DOCUMENTS

| | | |
|---|---|---|
| JP | 10250678 | 9/1998 |
| JP | 10250678 A * | 9/1998 |
| WO | 0064733 | 11/2000 |

* cited by examiner

*Primary Examiner* — Gregory Adams
(74) *Attorney, Agent, or Firm* — Roylance, Abrams, Berdo & Goodman, L.L.P.

(57) ABSTRACT

An ocean freight method and arrangement handles goods in a number of transport modes, such as containers, with the same transport in a cargo hold of an ocean vessel with cranes. The transport has a platform with a width corresponding to two regular containers to be loaded and unloaded by two parallel cranes enabling transportation of heavy and over wide units.

6 Claims, 2 Drawing Sheets

METHOD AND ARRANGEMENT FOR OCEAN FREIGHT TRANSPORTATION

FIELD OF THE INVENTION

The subject of the invention is a method and arrangement for ocean freight transportation.

BACKGROUND OF THE INVENTION

U.S. Pat. No. 4,043,285, U.S. Pat. No. 4,294,185, and U.S. Pat. No. 5,183,305 describe cargo vessels suitable for sea transport functions, which vessels have upper level cargo handling equipment and support structures for the loading and unloading of cargo containers. Such vessels, known as "Twinstar", maximize the load transport capacity, minimize idle time in ports and provide an extremely cost-effective system for the loading and unloading of cargo. The integrated container cranes on the vessels make it possible to achieve optimal efficiency in ports. By effecting saving manpower and time, they specifically decrease or even obviate the need for manual labor for loading and unloading vessels. In addition, a large amount of the transported cargo can be stored in a safe way with a minimum of time spent and with as little labor as possible. Also, loading and unloading operations can be safely carried out even in bad and windy weather conditions.

Furthermore, U.S. Pat. No. 6,230,640 describes a refrigeration arrangement suitable for the purposes mentioned above, which, first of all, includes heat insulation in the surrounding structures of a cargo vessel's hold, and, second, refrigeration units placed in the refrigeration areas that connect to the cargo holds. Thus, it is possible to stack a large volume of containerized cargo in the holds, while keeping it apart from the refrigeration units. The cargo containers supporting the cargo are equipped with numerous ventilation openings in order to direct the refrigeration air both around the cargo and through the containers' internal and external surfaces, and then back again to the refrigeration units.

Although cargo ships of the type described above are extremely efficient in handling regular containers, it has been found that they can also be further used more extensively than before for the transportation of heavy and/or over-width cargo, i.e., for units wider than regular containers. Specially designed heavy-cargo vessels have traditionally been used, where such ships are typically loaded using cranes on the dock, which then load the cargo from the side or from the stern by floating it.

Thus, the traditional heavy-cargo vessels have been designed specifically for transporting heavy units, which means that the areas in the cargo holds are built accordingly. For this reason, the transportation of regular containers on those vessel types is not possible without special arrangements. Therefore, container transportation is usually handled using regular container vessels, which use, for the loading and unloading of cargo, container guides in the holds specially designed for that purpose.

SUMMARY OF THE INVENTION

The purpose of the transportation method and arrangement in this invention is to effect a significant solution to the above-mentioned problems, and thus, significantly improve the prior art in this area.

The most important benefits that should be mentioned about this transportation method and arrangement, as described in this invention, are the simplicity and efficiency of the associated constructions, and the loading and sea transportation functions, especially due to the fact that the same ocean-going vessels can be utilized both simultaneously and separately, for the transportation of regular containers and of heavy and/or over-wide units.

A favorable application of the transportation method based on the invention encompasses a transportation platform having a bottom part with lifting posts that correspond to the lifting points on regular containers. The posts are designed for the connection of container crane lifting wires, chains or similar items. Thus, the invention allows for the handling of both heavy and/or over-wide units, as well as regular containers, using the standard container cranes on Twinstar-type vessels. Furthermore, the transportation platform, according to the invention, can be placed in the hold area of a cargo vessel, in the same manner as a regular container, and even into the same compartments with regular containers using the container guides in the hold.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 2:
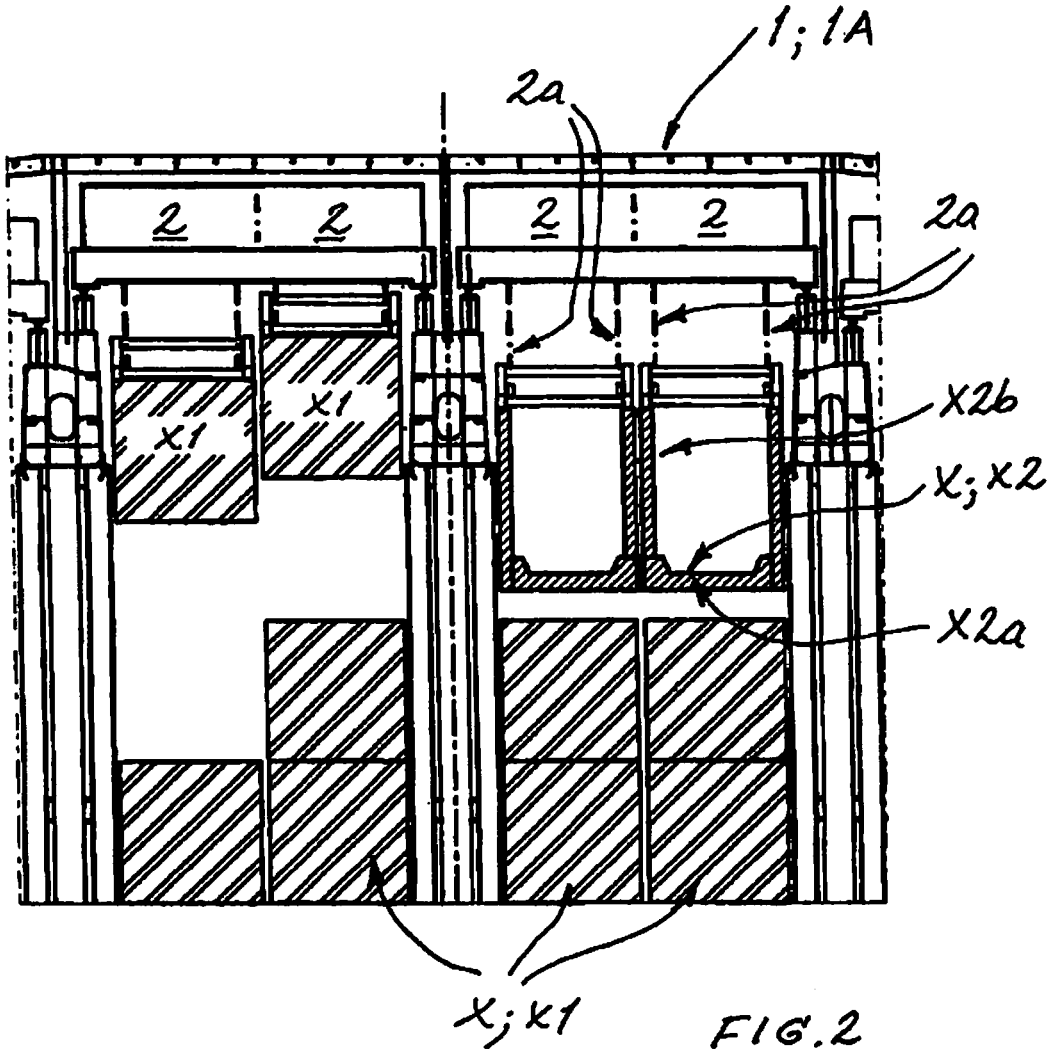
FIG. 2 is a partial end view in section of a cargo hold on an ocean freight vessel according to an exemplary embodiment of the invention.

The invention encompasses a method for ocean freight purposes. The transportation arrangement for handling the goods to be transported encompasses a number of means of transport X, such as containers X1 or similar, in order to transport goods with the same means of transport in a cargo hold of an ocean-going freight vessel 1, such as a cargo vessel, a barge or similar. The vessel is specially designed for container transportation and equipped with integrated container cranes 2. With reference to working principles illustrated in the example in FIG. 2, the means of transport is a transportation platform X2. The width L of platform X2 corresponds to two adjacent regular (e.g., 20 foot/40 foot long) transportation containers X1.

This transportation platform is used when the ocean freight vessel 1 is loaded/unloaded with two parallel container cranes 2, in order to enable the transportation of heavy units R and/or over-wide units in the ocean-going vessel's 1 container transportation area 1A.

The invention also encompasses a transportation arrangement for ocean freight purposes, where the transportation arrangement intended for handling the goods to be transported, encompasses a number of means of transport X, such as containers X1 or similar, in order to transport goods with the same means of transport in a cargo hold of an ocean freight vessel 1, such as a cargo vessel, a barge or similar. The vessel is specially designed for container transportation and equipped with integrated container cranes 2. The means of transport used in the transportation arrangement is a transportation platform X2. The width L of platform X2 corresponds to two adjacent regular (e.g., 20 foot/40 foot long) transportation containers X1. This transportation platform is used when the ocean-going freight vessel 1 is loaded/unloaded with two parallel container cranes 2, in order to enable the transportation of heavy units R and/or over-wide units in the ocean-going vessel's 1 container transportation area 1A.

With special reference to the favorable application as illustrated in FIG. 1, the transportation platform X2 encompasses a bottom X2*a* and lifting posts X2*b*, arranged on bottom X2*a* in the locations for regular (20 foot/40 foot) containers' X1 lifting points, for the purpose of connecting the container cranes' 2 lifting wires, chains 2*a* or similar items.

Furthermore, a favorable application encompasses a stiffening structure installed along the longitudinal s direction are along the transportation platform's X2 bottom X2*a*, in order to prevent bending. Thus, especially as illustrated in the view from the rear in FIG. 1*c*, longitudinal elevated structures X2*a*' or similar structures are arranged on the bottom's X2*a* outside edges and in the middle of it.

Figure 1A:
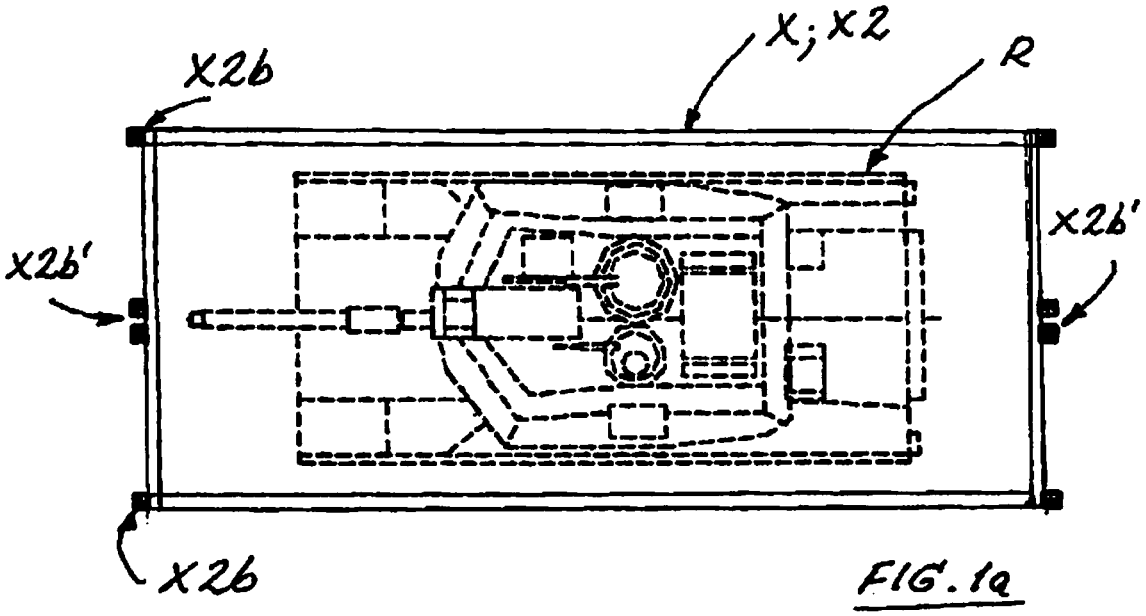
FIGS. 1*a*-1*c* are trop, side and rear views of a transportation platform according to an exemplary embodiment of the invention.
Figure 1B:
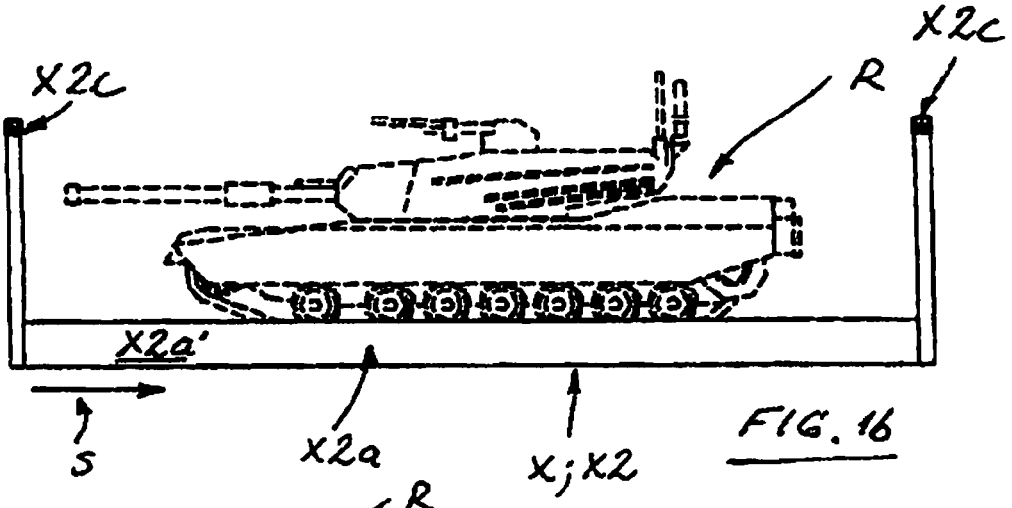
Figure 1C:
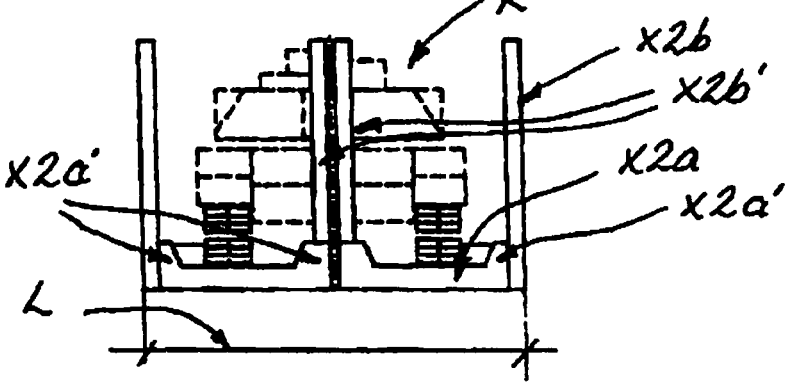

The transportation platform X2, which is specifically illustrated in FIGS. 1*a* and 1*b* encompasses a bottom X2*a*. The width of bottom X2*a* corresponds to two regular (40 foot) containers' X1 bottom area, when they are adjacent and parallel to each other. Into the bottom area's corners are connected through arrangements X2*c*, for example, lifting posts X2*b* equipped with lifting holes. Thus, a favorable application is further arranged in the midsection of the transportation platform's X2 front and rear edges, at the corresponding lifting points for regular parallel containers, two adjacent connection arrangements X2*c*, for example, lifting posts X2*b*' equipped with lifting holes.

Furthermore, as a favorable practical arrangement, the lifting posts X2*b*' installed in the transportation platform's X2 front and/or rear edges have been arranged so that they can be removed/laid down in order to enable the transfer/driving of heavy R and/or over-wide units onto the transportation platform X2.

It is clear that the invention is not limited to the applications presented or explained above, but it can, within the framework of the basic concept of the invention, be modified in many ways, first of all, by equipping the above-described transportation equipment unit types, for example, with deck parts or side plates that can be opened/removed and equipped with quick locking systems, etc., which allows for, for example, protecting the equipment being transported from weather conditions, for example, or for hiding it. In addition, in order to facilitate the storage of transportation equipment, it is possible to arrange all associated lifting posts so that they can be removed or laid down. The parts or subassemblies of the invention's transportation arrangement may consist of diverse materials manufactured using various techniques, in which connection parts of the structures can be of light metal, reinforced plastic, fiberglass, carbon fiber, composite construction, etc.

While one embodiment has been chosen to illustrate the invention, it will be understood by those skilled in the art that various changes and modifications can be made therein without departing from the scope of the invention as defined in the appended claims.

What is claimed is:

1. A method for handling freight for transportation in an ocean vessel comprising the steps of:

loading first freight on first platforms having a standard first width;

loading second freight on pairs of parallel second platforms of the standard first width, each of the pairs of second platforms being arranged and joined side-by-side to have a second width thereof and having substantially coplanar support surfaces, said second width being approximately twice said first width;

loading and unloading each pair of the first platforms with the first freight thereon with a crane into and out of a cargo area of the ocean vessel; and loading and unloading the second platforms with the second freight thereon with two parallel cranes into and out of the cargo area of the ocean vessel.

2. A method according to claim 1 wherein the two parallel cranes are attached to each pair of second platforms at lifting posts at corners of each second platform of each pair of the second platforms.

3. A method according to claim 1 wherein each of the first and second platforms has a common standard length.

4. A method according to claim 2 wherein each lifting post has a common standard height.

5. A method according to claim 3 wherein the first standard width is about 16 feet; and the common standard length is about 40 feet.

6. A method according to claim 2 wherein at least some of the lifting posts located between longitudinal sides of each pair of second platforms are moved to non-blocking positions to facilitate loading freight on the second platforms.

* * * * *